United States Patent [19]

Ishikawa

[11] 4,196,328

[45] Apr. 1, 1980

[54] ELECTRIC SWITCH

[75] Inventor: Kazuhiro Ishikawa, Tomioka, Japan

[73] Assignee: Iizuka Electric Industry Company Limited, Tomioka, Japan

[21] Appl. No.: 930,129

[22] Filed: Aug. 1, 1978

[30] Foreign Application Priority Data

Mar. 18, 1978 [JP] Japan ..... 53/34094

[51] Int. Cl.[2] ..... H01H 1/26

[52] U.S. Cl. ..... 200/246; 200/283; 200/DIG. 46

[58] Field of Search ..... 200/246, 250, 283, 288, 200/290, DIG. 46

[56] References Cited

U.S. PATENT DOCUMENTS

| | | | |
|---|---|---|---|
| 977,114 | 11/1910 | Manson | 200/283 |
| 1,969,488 | 8/1934 | Wagar | 200/246 |
| 2,156,465 | 5/1939 | Vigren et al. | 200/283 |
| 2,282,687 | 5/1942 | Vigren et al. | 200/283 |
| 2,739,209 | 3/1956 | Palmgren et al. | 200/246 |

FOREIGN PATENT DOCUMENTS

| | | | |
|---|---|---|---|
| 105548 | 2/1927 | Fed. Rep. of Germany | 200/246 |
| 2048132 | 10/1972 | Fed. Rep. of Germany | 200/246 |

*Primary Examiner*—Richard R. Stearns
*Attorney, Agent, or Firm*—Lawrence I. Field

[57] ABSTRACT

An electric switch comprising a plurality of electrically conductive resilient strips secured to an electrically insulating base member and a supporting member for supporting the strips in such a manner that these strips extend substantially in parallel with each other at a given distance and store resilient force in a direction opposite to that of an operational force. An electrical contact is made by displacing one of the resilient strips toward the other strip against the stored resilient force. In a preferred embodiment prior to securing the strips to the base member the strips have been bent in the direction opposite to the acting direction of the operational force.

4 Claims, 7 Drawing Figures

ELECTRIC SWITCH

BACKGROUND OF THE INVENTION

The invention relates to an electric switch comprising a plurality of electrically conductive resilient strips secured to an electrically insulating member in such a manner that the strips extend substantially in parallel with each other at a given distance, whereby the switch is caused to be either on or off by displacing one of the strips toward the other strip against the resilient force to make contact points secured on opposite surfaces at free ends of the strips in contact with each other.

In known electric switches of the kind mentioned above in order to effect a positive switching action it is necessary to adjust the distance between the resilient strips after assembling. Since the adjusting operation should be carried out for respective switches and is very cumbersome there is required a lot of time and labor. Further an electrical resistance of contact is mainly determined by a contact pressure and in order to obtain an excellent contact of sufficiently low electrical resistance it is necessary to bring the contact points of the strips in contact with each other with a high resilient force. But in order to attain the high contact pressure it is necessary to make large the amount of the displacement of the strips. This results in that the operation of the switch is liable to be unstable.

SUMMARY OF THE INVENTION

The invention has for its object to provide an electric switch which can obviate the drawbacks of the known switch and attain a good electrical contact of sufficiently low electrical resistance even with a slight displacement of the resilient strip.

It is another object of the invention to provide an electric switch in which the resilient strips can be automatically arranged in position without adjustment.

An electric switch according to the invention comprising a base member made of electrically insulating material; at least two resilient strips made of electrically conductive material, each having one end secured to the base member; and a supporting member coupled with the base member for supporting said resilient strips in such a manner that the resilient strips extend substantially in parallel with each other at a given distance and store a resilient force in a direction opposite to an acting direction of an operational force; whereby one of the resilient strips is forcibly displaced toward the other resilient strip against the stored resilient force and both resilient strips are forced into contact with each other.

In a preferred embodiment of the switch according to the invention the resilient strips have been bent in the direction opposite to that of the operational force before securing the strips to the base member.

DESCRIPTION OF THE PREFERRED EMBODIMENTS

Figure 1:
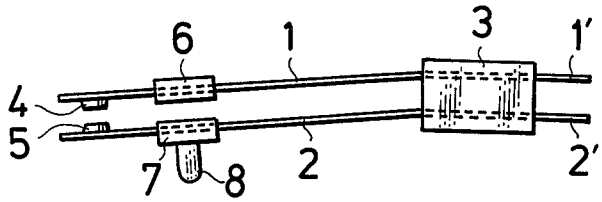
FIG. 1 is a side view showing an assembly of a base member and resilient strips of an embodiment of an electric switch according to the invention.
Figure 2:
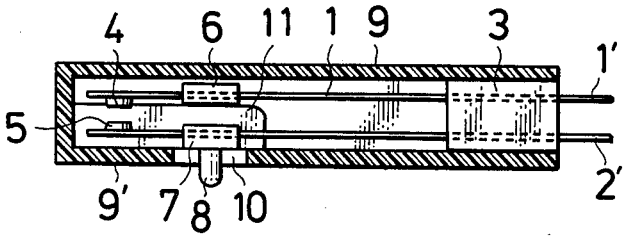
FIG. 2 is a longitudinal cross section illustrating a final assembly of the switch.
Figure 3:
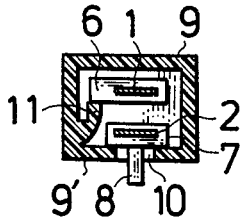
FIG. 3 is a lateral cross section of the final assembly of the switch.

FIGS. 1, 2 and 3 illustrate one embodiment of the electric switch according to the invention. The switch comprises a pair of resilient strips 1 and 2 made of leaf springs of electrically conductive metal. These strips each secured at one end to a base member 3 made of electrically insulating material in such a manner that the strips extend substantially in parallel with each other. In this embodiment the base member 3 is formed by a mold of synthetic resin and the resilient strips are secured to the base member by means of molding. Contact points 4 and 5 are secured to opposite surfaces at the free ends of the resilient strips 1 and 2, respectively. According to the invention the resilient strips 1 and 2 are not flattened, but have been bent in a direction opposite to an acting direction of an operational force, i.e. in a downward direction in the plane of FIG. 1. To the resilient strips 1 and 2 are secured stop members 6 and 7, respectively made of electrically insulating material such as synthetic resin. The stop member 7 has a protrusion 8 formed integrally therewith. The ends 1' and 2' of the strips 1 and 2 which are remote from the free ends extend from the base member 3. These ends 1' and 2' serve as contact terminals for connecting lead wires thereto by means of soldering, for example.

As shown in FIGS. 2 and 3 the assembly of the resilient strips 1, 2 and base member 3 is inserted into a casing 9 made of electrically insulating material such as mold body 3 of synthetic resin. The casing 9 includes a hole 10 formed in a bottom plate 9' and a projection 11. The stop member 6 is urged against the upper edge of the projection 11 and the stop member 7 is urged against the upper surface of the bottom plate 9' while the protrusion 8 of the stop member 7 extends beyond the bottom plate 9' through the opening 10.

Since the resilient strips 1 and 2 have been bent downward as shown in FIG. 1 and are supported in the casing 9 by the bottom plate 9' and the projection 11 against the resilient force of the strips, the resilient strips 1 and 2 tend to return to the initial positions shown in FIG. 1 and thus the resilient force acting downward is stored in the strips 1 and 2. Therefore the distance between the contact points 4 and 5 is automatically set to a correct value by means of the supporting member including the bottom plate 9' and the projection 11 without cumbersome adjustment after the assembling.

When the protrusion 8 of the stop member 7 is forced to displace upward by means of a driving or operation member (not shown) such as a magnet lever , the lower strip 2 is forced toward the upper strip 1 against its resilient force and the contact point 5 is placed in contact with the contact point 4. Then both strips 1 and 2 are forced to move upward. In this case since the strip 1 stores the resilient force acting downward the strip 1 generates a very strong downward resilient force even if it is displaced to a small extent. Thus the contact pressure of the contact points 4 and 5 becomes materially large and a stable electrical contact of low electrical resistance can be attained. Further when the operational force is removed, the resilient strips 1 and 2 return rapidly to the positions shown in FIG. 2 with the aid of the stored resilient force and thus it is possible to minimize a free vibration of the strips which might be a cause of chattering of the switch. In known switches in order to avoid such a chattering it is necessary to insert a member such as a sponge chip for damping or absorbing the vibration. According to the invention such a member can be dispensed with.

Figure 4:
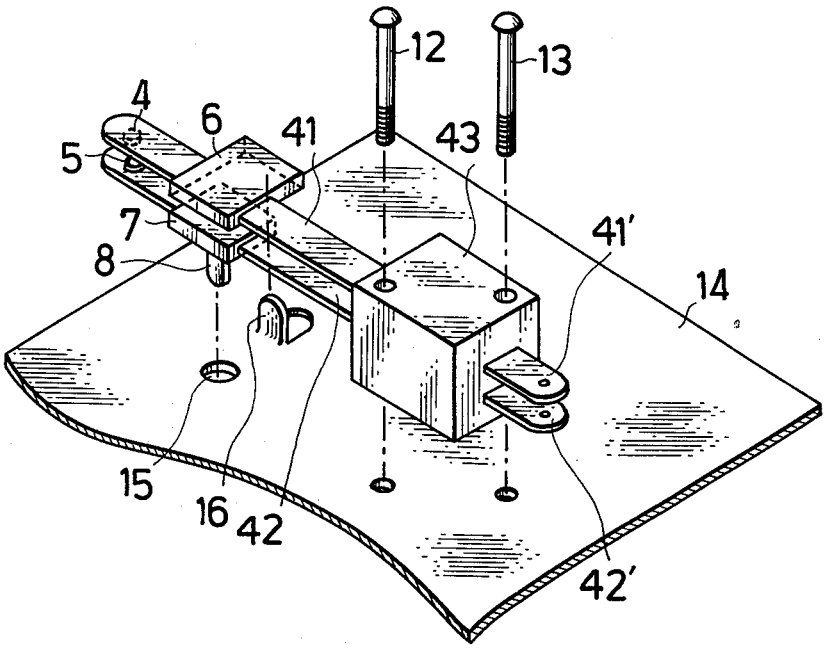
FIG. 4 is an exploded perspective view showing another embodiment of the electric switch according to the invention.

FIG. 4 is an exploded perspective view illustrating another embodiment of the electric switch according to the invention. In this embodiment use is made of a plate 14 such as a chassis instead of the casing 9 and a base member 43 is secured to the plate 14 by means of screws 12 and 13. In the plate 14 there are formed an opening 15 through which a protrusion 8 of stop member 7 secured to resilient strip 42 extends beyond the plate 14 and a projection lug 16 for supporting stop member 6 secured to a resilient strip 41. Also in this embodiment the strips 41 and 42 have been bent in the direction opposite to the acting direction of the operational force before assembling. By fixing the base member 43 at a predetermined position on the plate 14 the strips 41 and 42 are automatically placed in position while they store the resilient force acting in the direction opposite to that of the operational force. The ends of strips 41 and 42 are designated 41' and 42' in FIG. 4.

Figure 5:
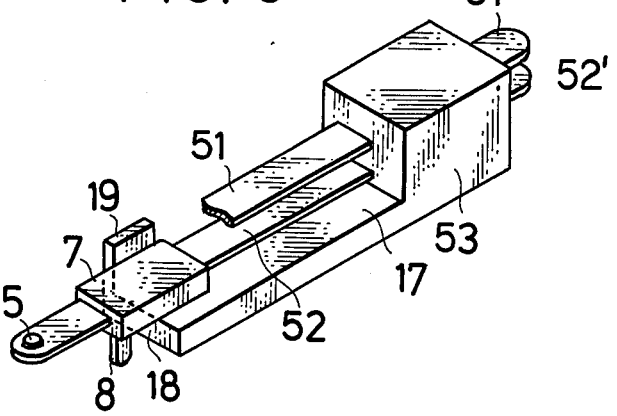
FIG. 5 is a perspective view illustrating another embodiment of the switch according to the invention.

FIG. 5 is a perspective view showing another embodiment of this electric switch according to the invention. In the embodiment the supporting member is formed integrally with a base member 53 by means of molding. That is to say an arm 17 is formed integrally with the base member 3 and an upright lug 19 is formed integrally with the arm 17 at its free end. A stop member 7 secured to a resilient strip 52 is urged against an upper surface of the arm 17 and a stop member (not shown) secured to another resilient strip 51 is urged against an upper edge of the upright lug 19. A protrusion 8 formed on the lower surface of the stop member 7 extends beyond an edge 18 of the arm 17. Also in this embodiment the resilient strips 51 and 52 have been bent in the direction opposite to that of the operational or driving force. The ends of strips 51 and 52 are designated 51' and 52' in FIG. 5.

Figure 6:
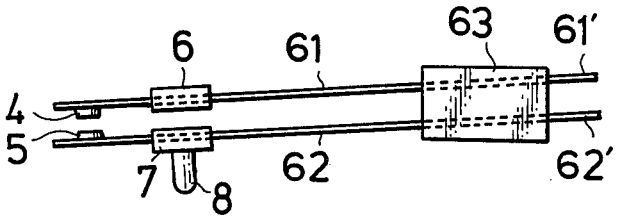
FIG. 6 is a side view depicting an assembly of the resilient strips and base member of another embodiment of the switch according to the invention.

The invention is not limited to the embodiments described above and many modifications can be conceived within the scope of the invention. For example in the above embodiments the resilient strips have been bent permanently in the direction opposite to the acting direction of the operational force, but this is not always necessary. According to the invention it is sufficient that the resilient strips store the resilient force acting in the direction opposite to that of the operational force in the assembled condition. For example as illustrated in FIG. 6 flat resilient strips 61 and 62 may be secured to a base member 63 in such a manner that they are inclined in the direction opposite to that of the operational force. In such an embodiment the supporting member is arranged at such a position that the resilient strips 61 and 62 are forced to displace in the direction of the operational force, i.e. upward in a plane of the drawing of FIG. 6.

Moreover the switch may include more than two resilient strips. It is not always necessary to provide the stop members 6 and 7, but the strips may be directly supported by the supporting member. In this case the supporting member is preferably made of electrically insulating material. Further the resilient strips may be secured to the base member with the aid of any suitable means.

Figure 7:
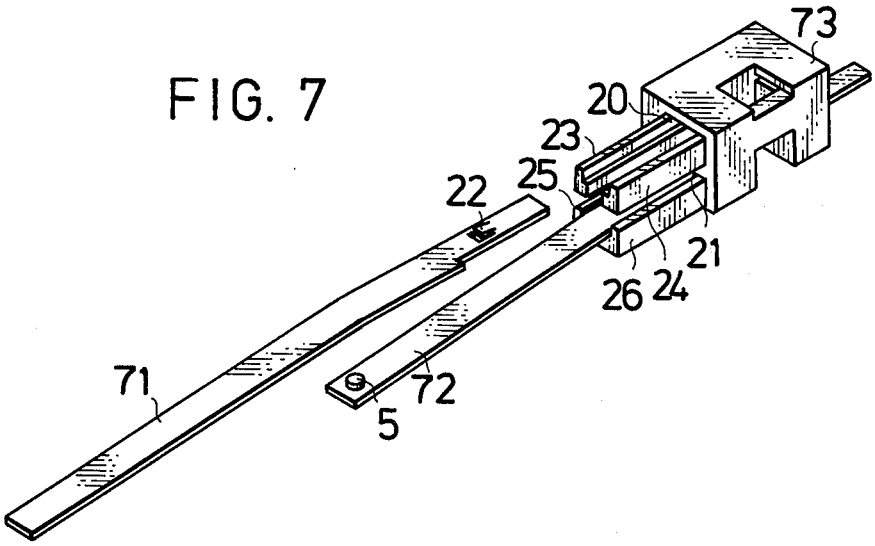
FIG. 7 is a perspective view showing still another embodiment of the electric switch according to the invention.

FIG. 7 is a perspective view showing still another embodiment of the electric switch according to the invention. In this embodiment a base member 73 has formed therein a pair of recesses 20 and 21 through which resilient strips 1 and 2 are inserted into the base member 3. The width of the recesses is substantially equal to the width of the strips so that the strips are firmly clamped in the recesses. In order to ensure that the strips are not disconnected from the base member 73 projections 22 may be formed in the strips 71 and 72, which projections engage with edges formed in the base member 73. Four protrusions 23 , 24 , 25 and 26 are formed integrally with the base member 73 for guiding the strips 71 and 72. These protrusions also serve as guide members for securing a casing as shown in FIG. 2.

What is claimed is:

1. An electric switch comprising:

a base member made of electrically insulating material;

at least two resilient strips made of electrically conductive material, each having one end secured to the base member and each of said strips having contact points secured to opposite surfaces adjacent to their free ends;

at least two stop members made of electrically insulating material and secured to the resilient strips, respectively;

a supporting member coupled with said base member for supporting the resilient strips at said member in such a manner that the strips extend in their longitudinal direction substantially in parallel with each other at a given distance, and wherein said supporting member comprises a bottom plate made of electrically insulating material and extending substantially in parallel with the resilient strips and a projection protruding from the bottom plate, the stop member secured to the first resilient strip adjacent to the bottom plate is placed in contact with the bottom plate, the stop member secured to the second resilient strip which situates opposite to the bottom plate with respect to the first resilient strip is engaged with the projection, and said stop member secured to the first strip includes a protrusion extending beyond the bottom plate, the driving force being applied to said protrusion; and means for actuating a resilient strip in an actuating direction substantially normal to said longitudinal direction, said resilient strip being secured to the base member so that the strip is held in position by an engagement of the stop member and the supporting member which storing a resilient force acting in a direction opposite to said actuating direction.

2. An electric switch according to claim 1, wherein said bottom plate has formed therein a recess through which said protrusion extends.

3. An electric switch according to claim 1, wherein said resilient strips have been bent in the direction opposite to the operational direction of the driving force before the strips are secured to the base member.

4. An electric switch according to claim 1 wherein said resilient strips are made planar and are secured to the base member and said strips are inclined towards said actuating means.

* * * * *